US011545772B2

(12) United States Patent
Nagasaka et al.

(10) Patent No.: US 11,545,772 B2
(45) Date of Patent: Jan. 3, 2023

(54) CONNECTOR

(71) Applicant: Yazaki Corporation, Tokyo (JP)

(72) Inventors: Naokazu Nagasaka, Shizuoka (JP); Kaoru Sawairi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/381,390

(22) Filed: Jul. 21, 2021

(65) Prior Publication Data

US 2022/0029327 A1 Jan. 27, 2022

(30) Foreign Application Priority Data

Jul. 27, 2020 (JP) ..... JP2020-126060

(51) Int. Cl.
*H01R 12/77* (2011.01)
*H01R 13/506* (2006.01)

(52) U.S. Cl.
CPC ..... *H01R 12/771* (2013.01); *H01R 13/506* (2013.01)

(58) Field of Classification Search
CPC .. H01R 12/771; H01R 12/772; H01R 12/774; H01R 1/777; H01R 12/778; H01R 12/77
See application file for complete search history.

(56) References Cited

U.S. PATENT DOCUMENTS

2009/0023324 A1* 1/2009 Koike ..... H01R 12/79 439/492
2020/0044376 A1 2/2020 Ichikawa et al.

FOREIGN PATENT DOCUMENTS

JP 2020-021595 A 2/2020

* cited by examiner

*Primary Examiner* — Ross N Gushi
(74) *Attorney, Agent, or Firm* — Sughrue Mion, PLLC

(57) ABSTRACT

A connector includes: a terminal fitting; a housing including a smooth terminal lead-out area where a terminal outlet for projecting a conductor connection part of the terminal fitting on the inner side toward an outer side is provided; a conductive component shaped in a sheet-like form with a conductor and an insulator exhibiting flexibility, the conductive component including a conductor connection area that physically and electrically connects the conductor to the conductor connection part, and a conductor lead-out area led out from the conductor connection area toward a lead-out direction projecting from the housing; and a reinforcing plate shaped in a planar shape with an insulating material, the reinforcing plate being sandwiched between the conductor connection area and the terminal lead-out area. The housing includes a protruded body protruded toward the conductor lead-out area side of the conductive component than a same plane with the terminal lead-out area.

20 Claims, 11 Drawing Sheets

CONNECTOR

CROSS-REFERENCE TO RELATED APPLICATION(S)

The present application claims priority to and incorporates by reference the entire contents of Japanese Patent Application No. 2020-126060 filed in Japan on Jul. 27, 2020.

BACKGROUND OF THE INVENTION

1. Field of the Invention

The present invention relates to a connector.

2. Description of the Related Art

As conventionally known connectors, there is a type that includes a terminal fitting, a housing in which the terminal fitting is accommodated, and a conductive component that is formed in a sheet-like form having flexibility such as a flexible printed circuit (what is called FPC) to be electrically connected to the terminal fitting. As for the connector, the conductive component includes: a conductor connection area that is physically and electrically connected to a protruded portion of the terminal fitting from the housing; and a conductor lead-out area that is led out from the conductor connection area to be projecting from the housing. Furthermore, also known is a connector in which the strength of the conductor connection area in the conductive component is increased with a reinforcing plate. This type of connector is disclosed in Japanese Patent Application Laid-open No. 2020-21595, for example.

Incidentally, until assembling of the connector to a prescribed position of a vehicle or the like is completed (that is, until the conductor lead-out area is fixed to the outside of the conductive component) such as while the conductive component is transported to an assembling factory, the conductive component is in a cantilever state with the conductor connection area being the fixed end and the conductor lead-out area side being the free end. Therefore, as for the conductive component, the conductor lead-out area side may be oscillated to the planar direction due to the externally applied force such as vibration during transportation or the conductor lead-out area side may droop in the planar direction by its own weight. Further, as a result of oscillation and drooping of the conductor lead-out area side, the conductive component may be bent from the end of the reinforcing plate on the conductor lead-out area side of the conductive component, so that overload may be applied to the bent part. In general, in the conductive component, a circuit part such as a circuit pattern is formed also in the part that is bent. Therefore, in view of the influence of such overload imposed upon the circuit part, this connector still has room for improvement.

SUMMARY OF THE INVENTION

It is therefore an object of the present invention to provide a connector capable of lightening the load imposed upon the conductive component.

In order to achieve the above mentioned object, a connector according to one aspect of the present invention includes a terminal fitting including a terminal, part and a conductor connection part; a housing including an inner housing chamber for accommodating the terminal part, and a smooth terminal lead-out area where a terminal outlet for projecting the conductor connection part toward an outer side from the housing chamber is provided; a conductive component that is a component shaped in a sheet-like form with a conductor and an insulator exhibiting flexibility, the conductive component including a conductor connection area that physically and electrically connects the conductor to the conductor connection part, and a conductor lead-out area that is led out from the conductor connection area toward a lead-out direction to be projecting from the housing; and a reinforcing plate shaped in a planar shape with an insulating material, the reinforcing plate being sandwiched between the conductor connection area and the terminal lead-out area with a first plane being in contact with the conductor connection area and a second plane being in contact with the terminal lead-out area, wherein the housing includes, on the lead-out direction side than the terminal lead-out area, a protruded body that is protruded toward the conductor lead-out area side of the conductive component than a same plane with the terminal lead-out area.

According to another aspect of the present invention, in the connector, it is desirable that the protruded body includes a chamfered part formed by chamfering an intersection part where an end face on a protruding direction of the protruded body intersects with an end face on the lead-out direction side.

According to still another aspect of the present invention, in the connector, it is desirable that the chamfered part is an arc-like chamfered part rounded in an arc-like shape.

According to still another aspect of the present invention, in the connector, it is desirable that the protruded body is protruded to a position equivalent to the first plane of the reinforcing plate with the second plane being in contact with the terminal lead-out area or to a position higher than the first plane.

According to still another aspect of the present invention, in the connector, it is desirable that an end face of the protruded body on a protruding direction side is extended in an orthogonal direction with respect to the protruding direction and with respect to the lead-out direction, and extended over one end to the other end of the conductor lead-out area along the orthogonal direction.

According to still another aspect of the present invention, in the connector, it is desirable that in the reinforcing plate, an intersection part where the first plane intersects with an end face on the lead-out direction side is formed in a sharp edge form.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
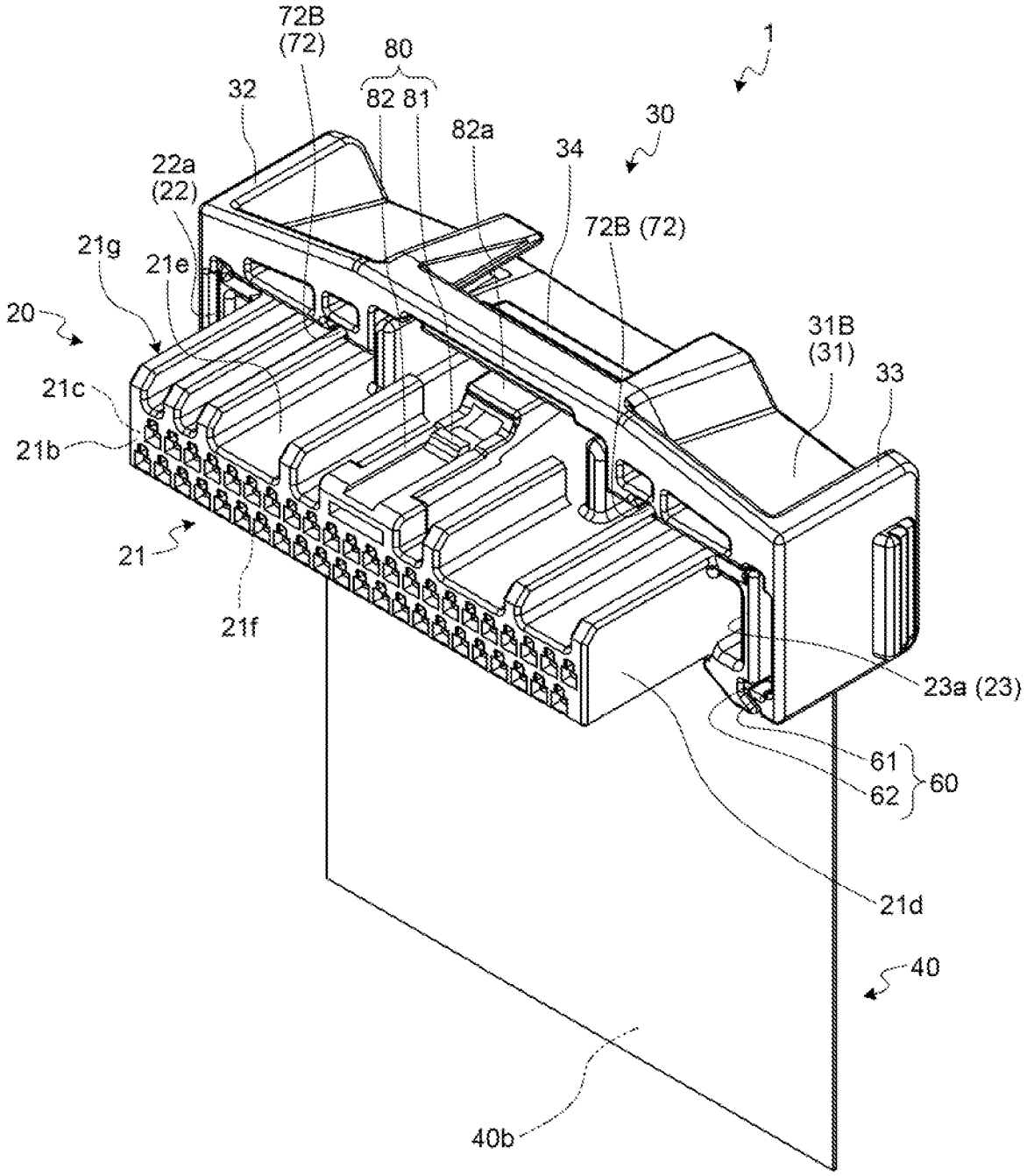
FIG. 1 is a perspective view illustrating a connector of an embodiment.

Hereinafter, an embodiment of a connector according to the present invention will be described in detail with reference to the accompanying drawings. Note that the invention is not limited to this embodiment.

Embodiment

One embodiment of the connector according to the present invention will be described with reference to FIG. 1 to FIG. 11.

Reference numeral 1 in FIG. 1 to FIG. 9 indicates the connector of the embodiment. The connector 1 includes: a terminal fitting 10; a housing 20 in which the terminal fitting 10 is accommodated; a cover 30 assembled to the housing 20; and a conductive component 40 that is physically and electrically connected to the terminal fitting 10 in an inner space formed with the housing 20 and the cover 30 in an assembled state, and led out to an outer side from the inner space. Furthermore, the connector 1 includes a reinforcing plate 50 that partially reinforces the conductive component 40.

Figure 4:
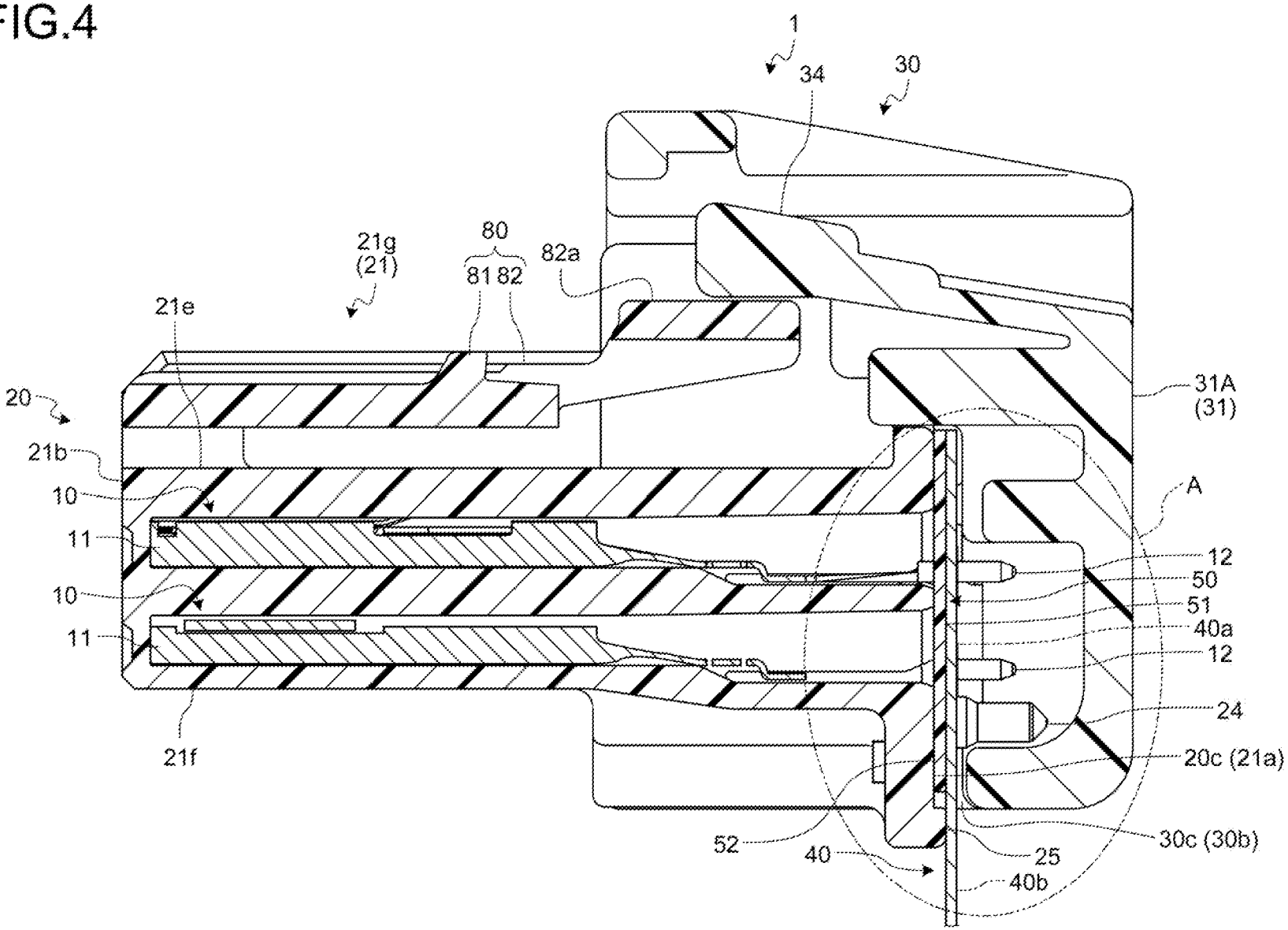
FIG. 4 is a sectional view taken along X-X line of FIG. 2.
Figure 6:
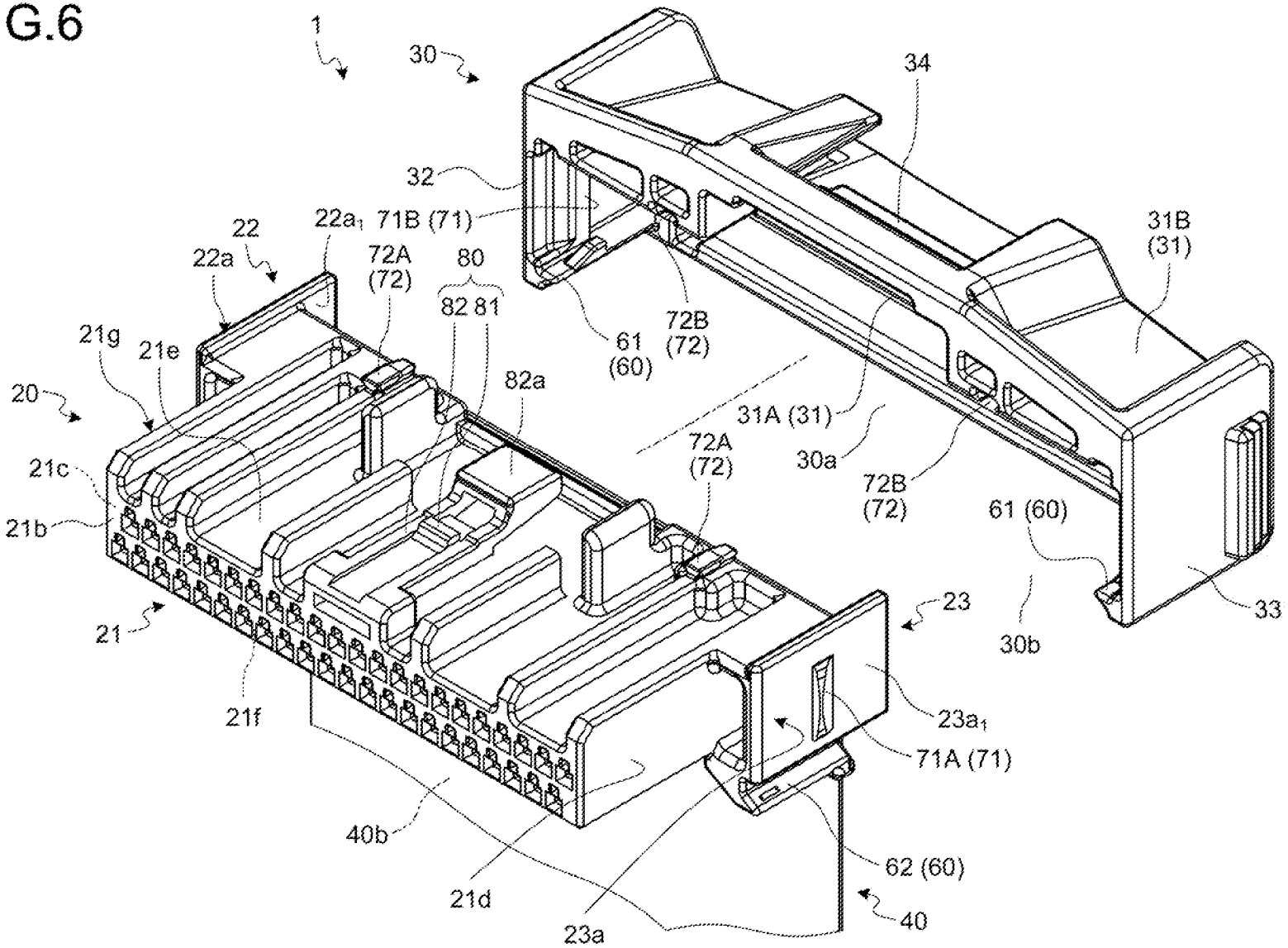
FIG. 6 is an exploded perspective view of the connector before the cover is connected when viewed from another angle.
Figure 7:
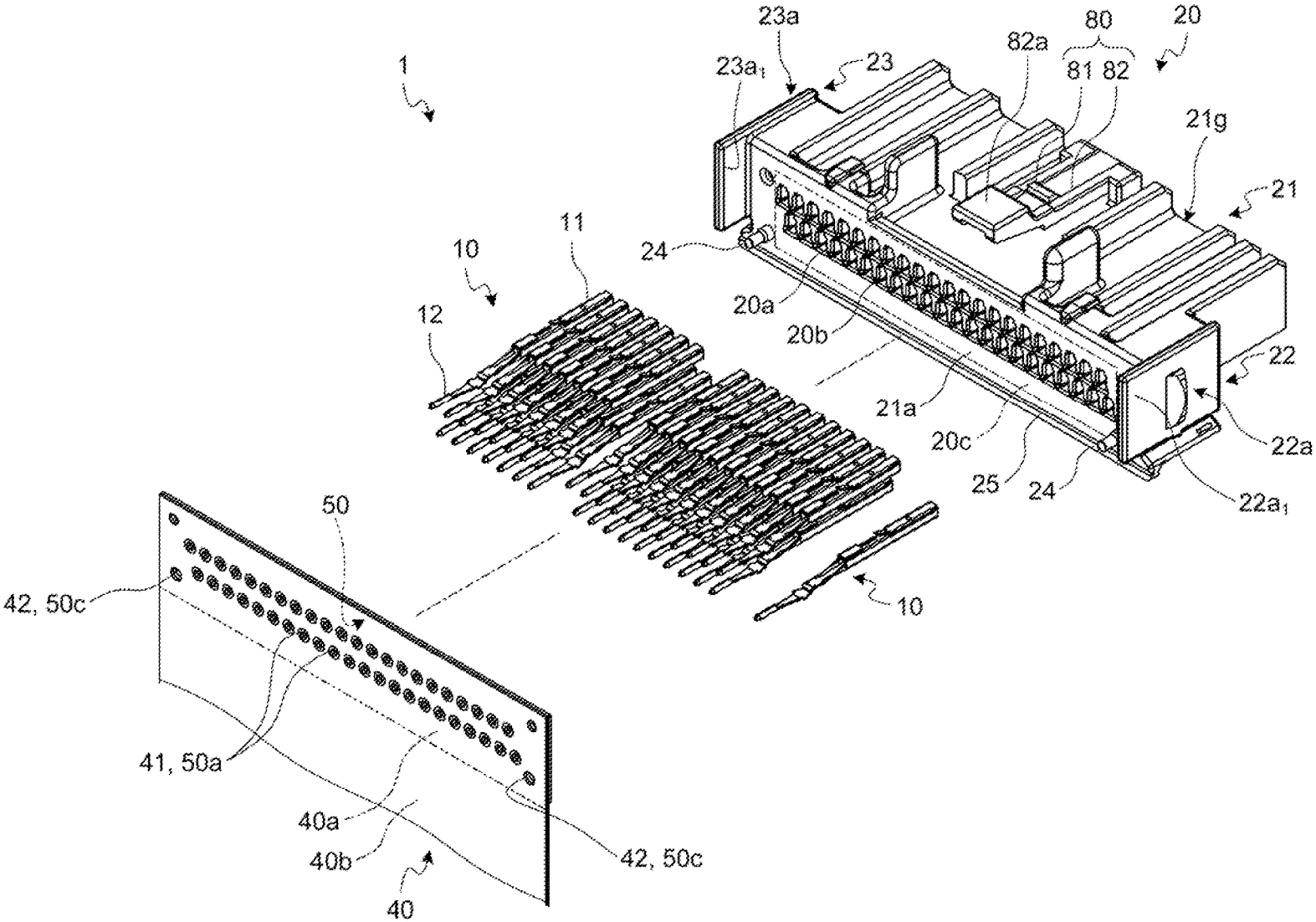
FIG. 7 is an exploded perspective view of the connector (excluding the cover) of the embodiment.

The terminal fitting 10 is formed with a conductive material such as metal. For example, the terminal fitting 10 is shaped in a prescribed shape by press molding such as folding work and cutting work performed on a metal plate as a base material. The terminal fitting 10 includes a terminal part 11 that is physically and electrically connected to a mating terminal fitting 510 of a mating connector 501 (FIG. 9), and a conductor connection part 12 that is physically and electrically connected to a conductive component EC (FIG. 4, FIG. 7, and FIG. 6). Note that the mating connector 501 may be a connector that is electrically connected to a mating electric device (inverter or the like) or may be a part like a connector part of a terminal block provided to the mating electric device, for example.

The terminal part 11 is formed in a female terminal shape or a male terminal shape, for example. The terminal part 11 discussed herein is formed in a female terminal shape having a rectangular tubular box body, and the mating terminal fitting 510 is inserted and extracted along the axial direction thereof. Furthermore, the conductor connection part 12 is formed in a cylindrical shape with its axial direction facing in the same direction as the axial direction of the terminal part 11.

The connector 1 of the embodiment is configured by including a single or a plurality of the terminal fittings 10. The connector 1 discussed herein includes a plurality of the terminal fittings 10.

The housing 20 is shaped with an insulating material such as a synthetic resin. The housing 20 includes an inner housing chamber 20*a* for accommodating the terminal part 11 of the terminal fitting 10, and an opening (hereinafter, referred to as "terminal outlet") 20*b* from which the conductor connection part 12 of the terminal fitting 10 projects toward an outer side from the housing chamber 20*a* (FIG. 7). Furthermore, the housing 20 includes a smooth terminal lead-out area 20*c* where the terminal outlet 20*b* is provided (FIG. 7). With the housing 20, the terminal part 11 is accommodated in the housing chamber 20*a* from the terminal outlet 20*b*, and the conductor connection part 12 projects from the terminal outlet 20*b* in the direction opposite from a connector fitting direction for the mating connector 501 (that is, in a connector removal direction).

In the housing 20 discussed herein, a plurality of the housing chambers 20*a* are provided, and the terminal part 11 is accommodated in each of the housing chambers 20*a*. All of the housing chambers 20*a* are formed such that the terminal part 11 is accommodated in each of the housing chambers 20*a* by facing toward the same direction and that each of the terminal outlets 20*b* is arranged on the same plane. Furthermore, in the housing 20, all of the housing chambers 20*a* are arranged in a grid-like form. Therefore, the housing 20 discussed herein includes the rectangular and smooth terminal lead-out area 20*c* where the terminal outlets 20*b* are provided.

In the connector 1, it is not necessary to accommodate the terminal fitting 10 in all of the housing chambers 20*a* but only need to accommodate the terminal fitting 10 in the housing chambers 20*a* at the places required on an electric circuit.

The housing 20 discussed herein includes a housing main body 21 where all of the housing chambers 20*a* are formed (FIG. 1 to FIG. 8). The housing main body 21 illustrated herein is formed in a cuboid shape, and includes a first to sixth outer wall faces 21*a* to 21*f* (FIG. 1 to FIG. 6).

All of the terminal outlets 20*b* are arranged on the first outer wall face 21*a*. Therefore, the terminal lead-out area 20*c* is provided on the first outer wall face 21*a* (FIG. 7).

In the housing main body 21, the third outer wall face 21*c* and the fourth outer wall face 21*d* are arranged in a parallel state, and joined to the first outer wall face 21*a* in an orthogonal state. In the housing 20, the conductor connection parts 12 of all of the terminal fittings 10 projecting from the terminal outlets 20*b* are covered from the third outer wall face 21*c* side and the fourth outer wall face 21*d* side for protection. Therefore, the housing 20 includes: a first protector 22 that is connected in an opposingly disposed state with respect to the third outer wall face 21*c* with a space provided therebetween, and also protruded outward of the first outer wall face 21*a*; and a second protector 23 that is connected in an opposingly disposed state with respect to the fourth outer wall face 21*d* with a space provided therebetween, and also protruded outward of the first outer wall face 21*a* (FIG. 1 to FIG. 3 and FIG. 5 to FIG. 8).

The first protector 22 and the second protector 23 are arranged in a part of the housing main body 21 excluding a fitting connection part 21*g* (FIG. 1 and FIG. 5 to FIG. 8).

The fitting connection part 21*g* is a part that can be fitted and connected into a mating fitting connection part 521*g* of a mating housing 520 (FIG. 9) along the connector insertion direction and can be pulled out from the inner side of the mating fitting connection part 521*g* along the connector removal direction, and the terminal fitting 10 is accommodated inside thereof. The fitting connection part 21*g* is provided on the second outer wall face 21*b* side of the housing main body 21. Therefore, the first protector 22 and the second protector 23 are arranged on the first outer wall face 21*a* side of the housing main body 21. Furthermore, in the housing 20, the first protector 22 is disposed at an end on one of the sides, and the second protector 23 is disposed at an end on the other side. Therefore, hereinafter, the first protector 22 is referred to as a "first housing sidewall 22" and the second protector 23 as a "second housing sidewall 23" as necessary.

The first protector 22 illustrated herein includes a rectangular planar flat plate part 22*a* that is opposingly disposed in a parallel state with respect to the third outer wall face 21*c* with a space provided therebetween (FIG. 1, FIG. 2, and FIG. 5 to FIG. 8). In the first protector 22, the flat plate part 22*a* includes a protruded part $\mathbf{22}a_1$ that is protruded outward of the first outer wall face 21*a*, and the conductor connection parts 12 of all of the terminal fittings 10 are covered with the protruded part $\mathbf{22}a_1$ from the third outer wall face 21*c* side. Furthermore, the second protector 23 illustrated herein includes a rectangular planar flat plate part 23*a* that is opposingly disposed in a parallel state with respect to the fourth outer wall face 21*d* with a space provided therebetween (FIG. 1, FIG. 2, and FIG. 5 to FIG. 8). In the second protector 23, the flat plate part 23*a* includes a protruded part 2:3*a*; that is protruded outward of the first outer wall face 21*a*, and the conductor connection parts 12 of all of the terminal fittings 10 are covered with the protruded part 23*a*; from the fourth outer wall face 21*d* side.

Furthermore, in the housing main body 21, the fifth outer wall face 21*e* and the sixth outer wall face 21*f* are arranged in a parallel state and joined, in an orthogonal state, to each of the first outer wall face 21*a*, the third outer wall face 21*c*, and the fourth outer wall face 21*d*. With the connector 1 discussed herein, the conductive component 40 is led toward the sixth outer wall face 21*f* side as will be described later.

With the connector 1, before assembling the cover 30 to the housing 20, the conductive component 40 is connected to the terminal fittings 10 accommodated in the housing chambers 20*a*.

The conductive component 40 of the embodiment is a component shaped into a sheet form with a conductor or an insulator having flexibility (pliability, so to speak), and a flat flexible laminate formed by the conductor or the insulator is used for the conductive component 40. The conductive component 40 includes a plurality of conductors, and a circuit part is formed with each of the conductors. Examples of the conductive component 40 may be a printed circuit body such a flexible printed circuit (what is called FPC) and a membrane wiring board, a flat cable (what is called FC), a flexible flat cable (what is called FFC), and the like. The conductive component 40 discussed herein is a flexible printed circuit (what is called FPC), and it is formed in a rectangular shape.

Figure 3:
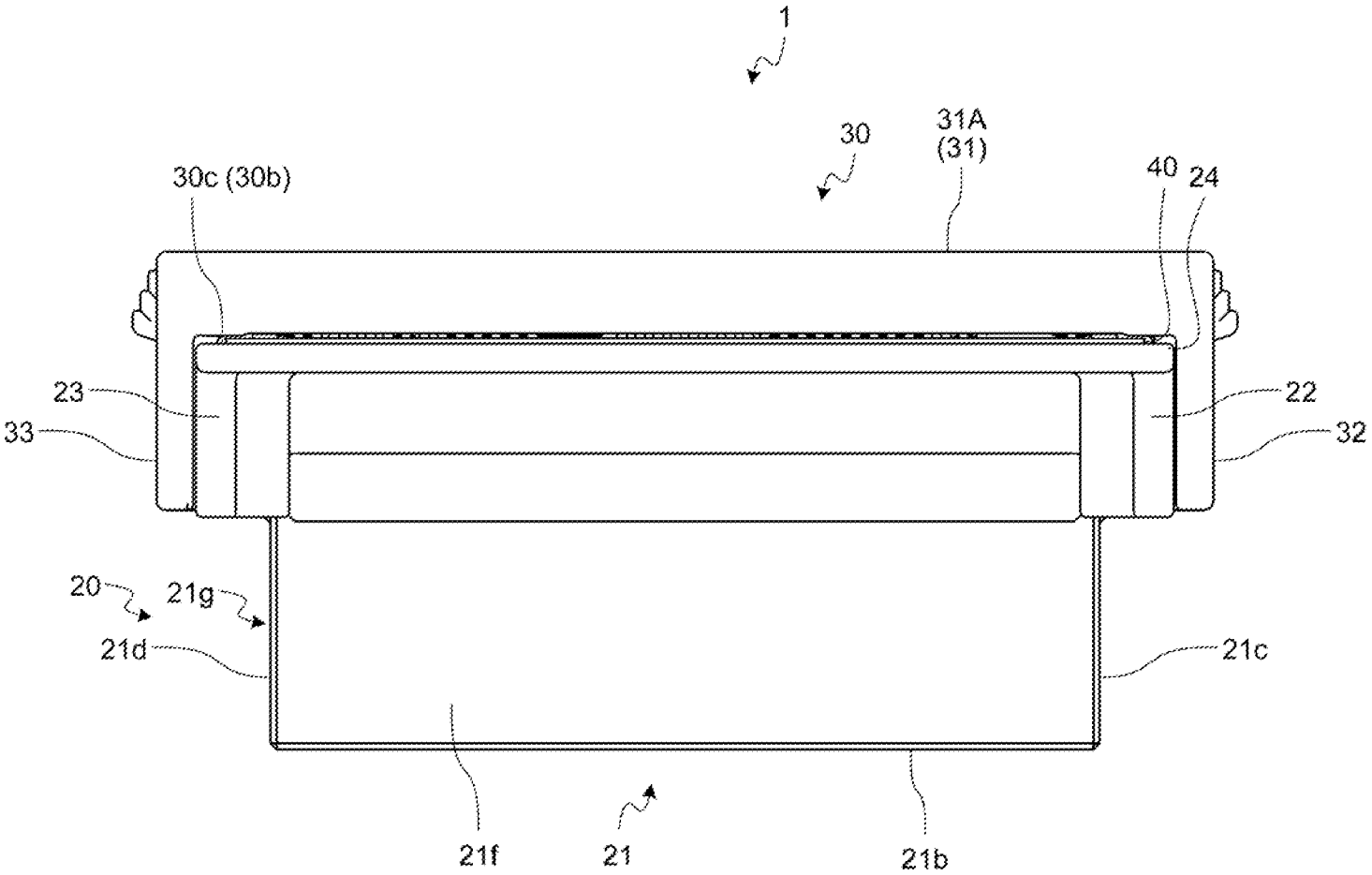
FIG. 3 is a plan view of the connector of the embodiment when viewed from an outlet side.
Figure 5:
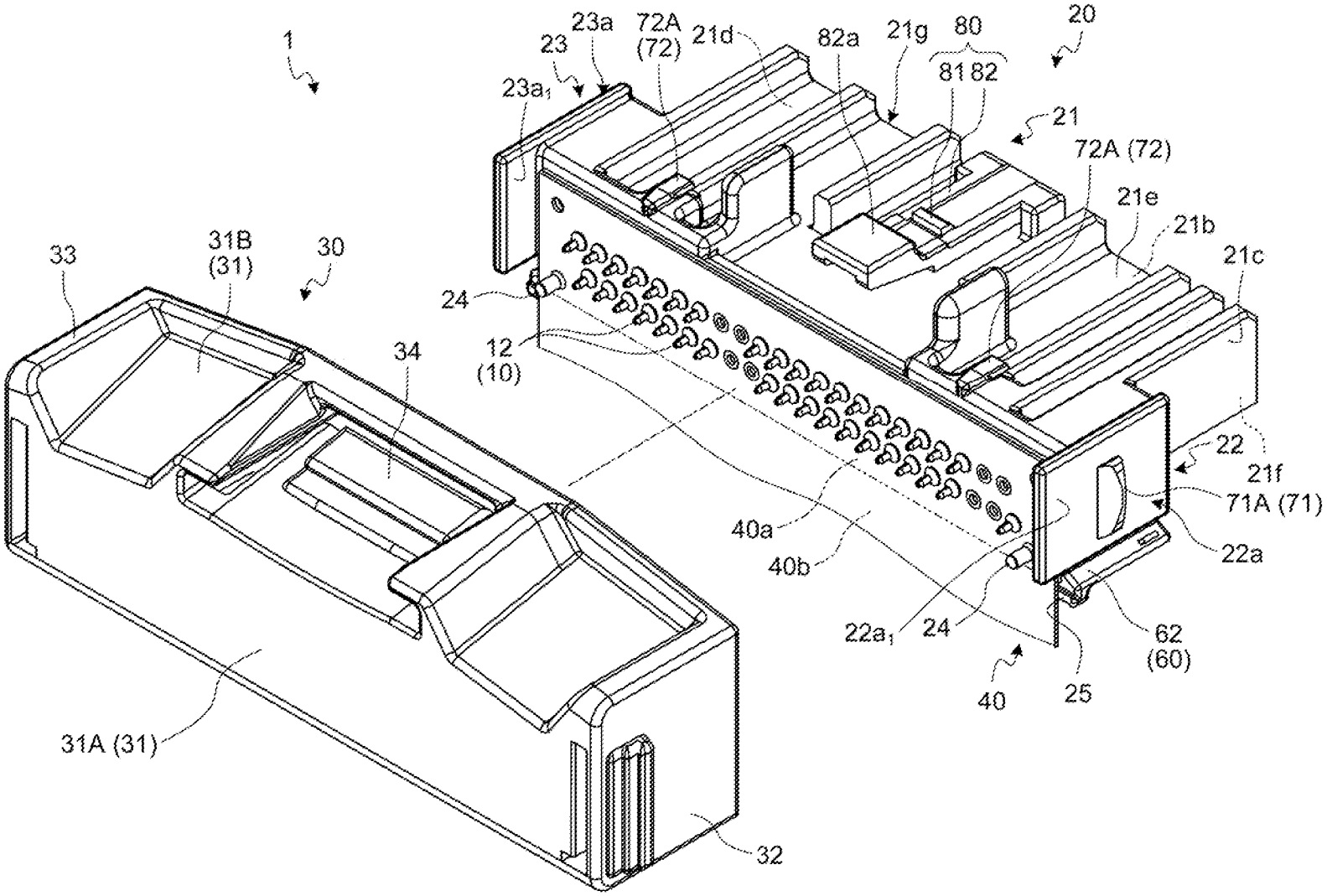
FIG. 5 is an exploded perspective view of the connector before a cover is connected.

The conductive component 40 includes: a conductor connection area 40*a* that physically and electrically connects the conductor to the conductor connection part 12 of the terminal fitting 10 projecting from the terminal outlet 20*b*; and a conductor lead-out area 40*b* that is led out from the conductor connection area 40*a* toward the lead-out direction to be projecting from the housing 20 (FIG. 4, FIG. 5, and FIG. 7). As for the conductive component 40, the conductor connection area 40*a* is accommodated in the inner space formed by the housing 20 and the cover 30 in a completely assembled state, and the conductor lead-out area 40*b* is led out to the outside from an outlet 30*c* formed with the housing 20 and the cover 30 in the completely assembled state (FIG. 3 and FIG. 4). The conductive component 40 herein is sectioned into the rectangular conductor connection area 40*a* and the rectangular conductor lead-out area 40*b*. Hereinafter, "lead-out direction" means the lead-out direction of the conductor lead-out area 40*b* of the conductive component 40 unless otherwise stated.

Figure 8:
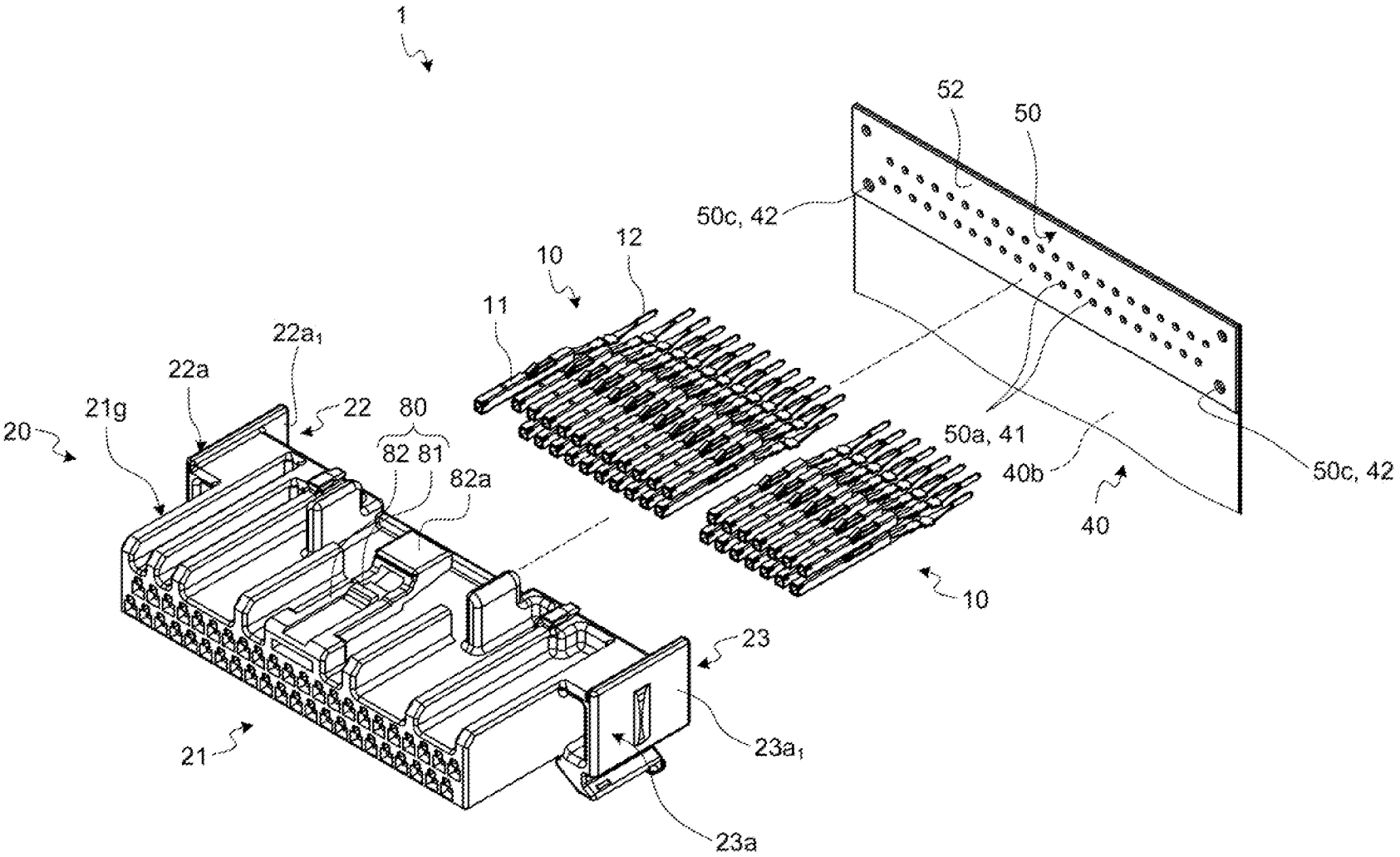
FIG. 8 is an exploded perspective view of the connector (excluding the cover) of the embodiment when viewed from another angle.
Figure 9:
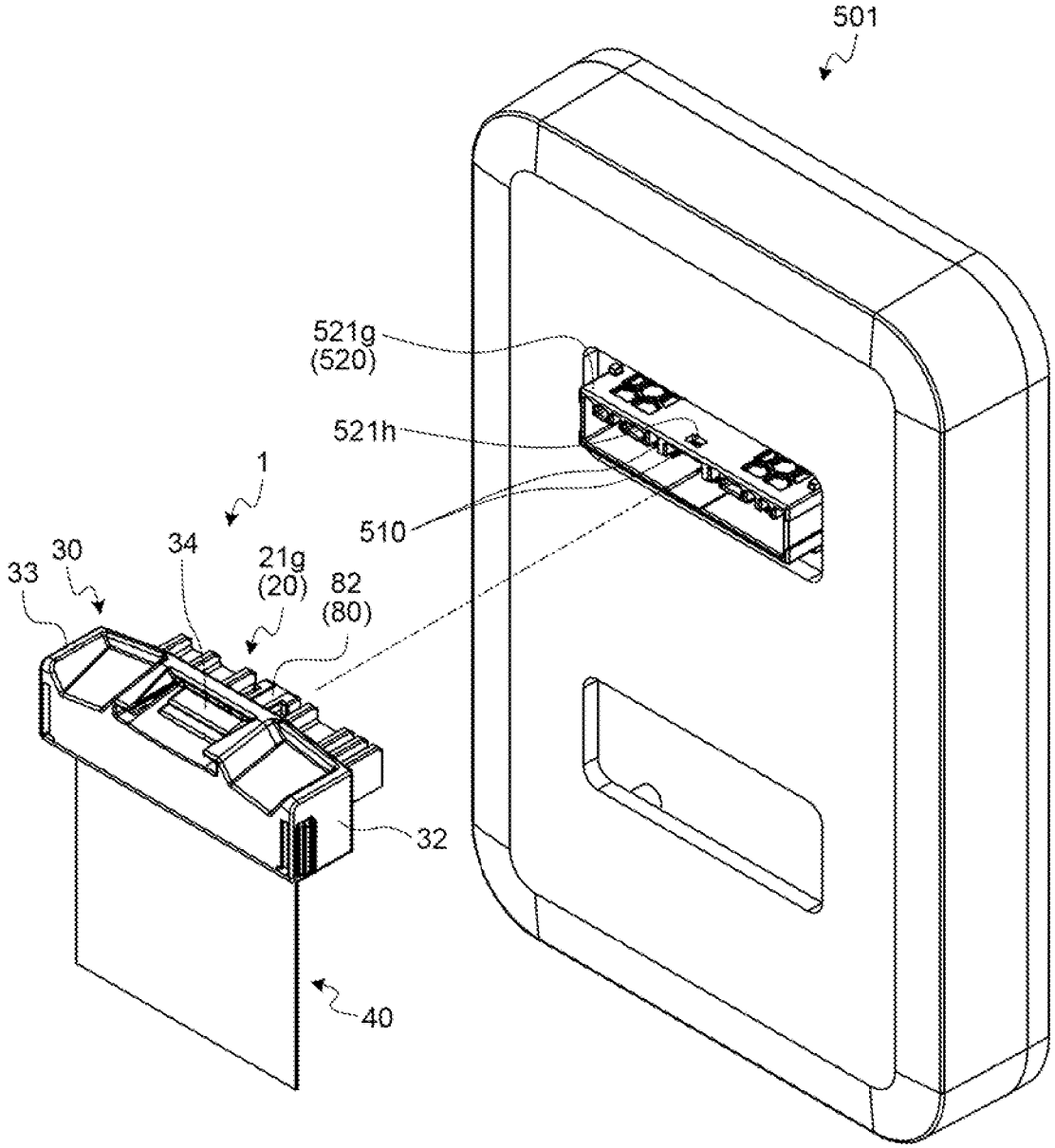
FIG. 9 is a perspective view illustrating the connector of the embodiment along with a mating connector.

The conductor connection area 40*a* includes a through-hole 41 that is a perforated hole for inserting the conductor connection part 12, and that allows the electric connection part of the conductor on an inner circumferential face of the perforated hole to be electrically connected to the conductor connection part 12 (FIG. 7 and FIG. 8). In the conductor connection area 40*a*, the through-hole 41 in a circular shape is formed for each of the terminal fittings 10 for electrically connecting the conductor connection parts 12 of all of the terminal fittings 10.

Note here that the conductor connection area 40*a* has its strength reinforced by the reinforcing plate 50. Therefore, the reinforcing plate 50 is integrated with the conductor connection area 40*a* in a laminated state (FIG. 4, FIG. 7, and FIG. 8). The reinforcing plate 50 is formed in a planar shape with an insulating material such as a synthetic resin. The reinforcing plate 50 discussed herein is formed as a flat plate having an outer shape same as that of the conductor connection area 40*a* (that is, in a rectangular shape same as that of the conductor connection area 40*a*). The reinforcing plate 50 has a first plane 51 to be in contact with the conductor connection area 40*a* and, by adhering the first plane 51 to the conductor connection area 40*a* with an adhesive or the like, the reinforcing plate 50 is integrated with the conductor connection area 40*a* in a laminated state (FIG. 4 and FIG. 10).

Figure 10:
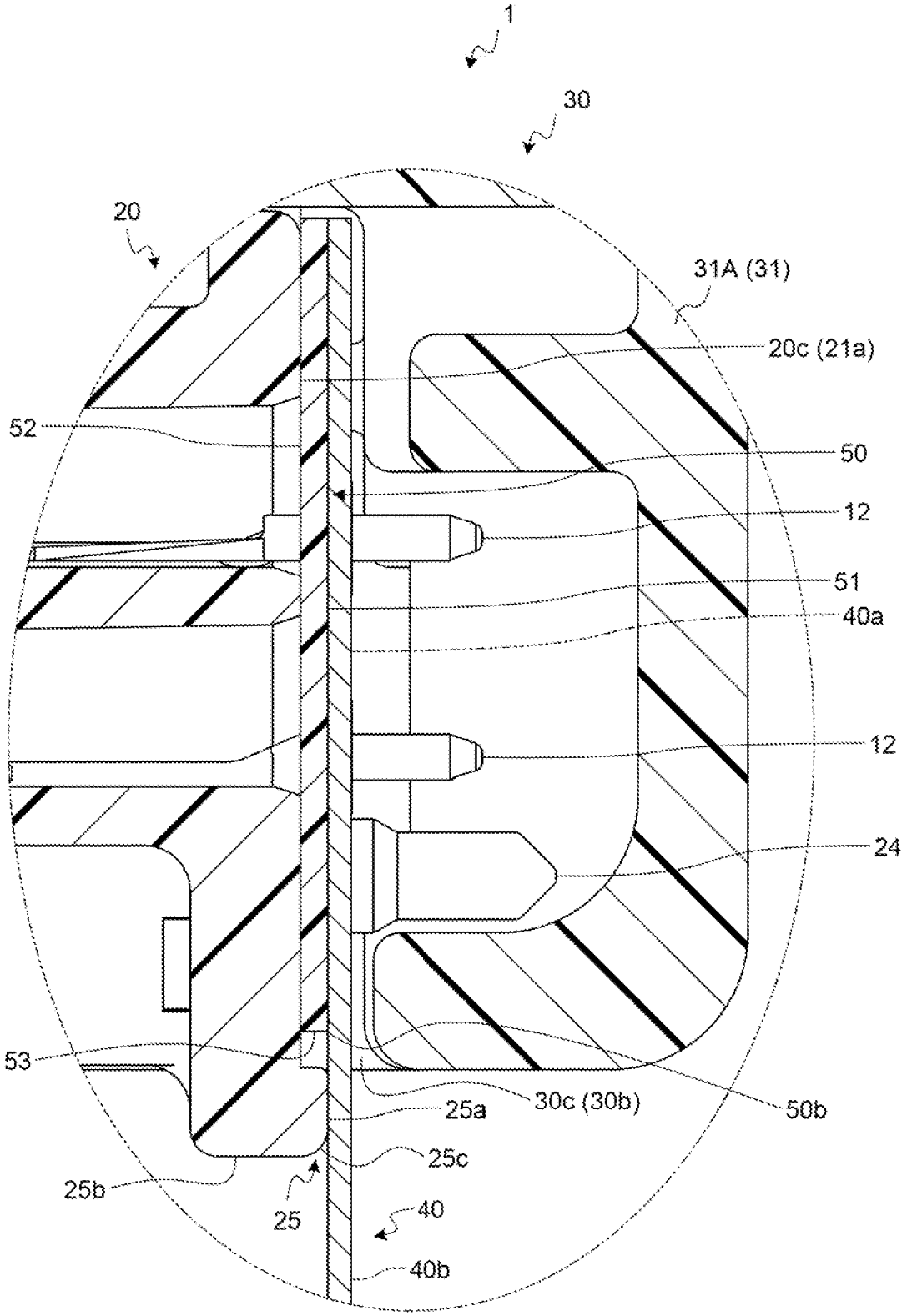
FIG. 10 is an enlarged view of A part of FIG. 4.
Figure 11:
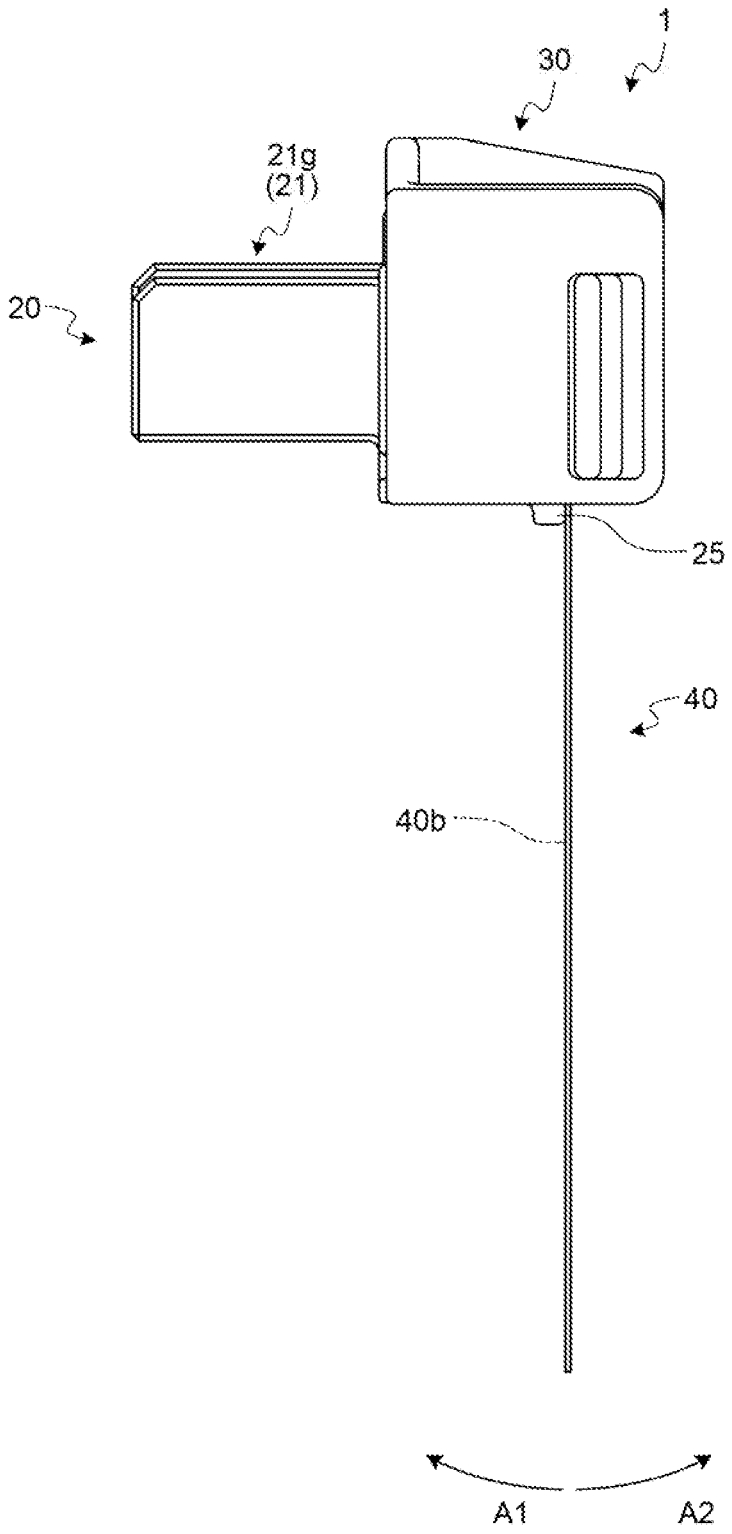
FIG. 11 is a plan view of the connector of the embodiment when viewed from a side, which is a diagram for explaining oscillation of a conductive component.

As for the reinforcing plate 50, the first plane 51 is brought in contact with the conductor connection area 40*a* and a second plane 52 is brought in contact with the terminal lead-out area 20*c* to be sandwiched between the conductor connection area 40*a* and the terminal lead-out area 20*c* (FIG. 4 and FIG. 10). Therefore, in the reinforcing plate 50, a perforated hole (hereinafter, referred to as "terminal insertion hole") 50*a* concentric with the through-hole 41 is formed for each of the through-holes 41 (FIG. 7 and FIG. 8). The terminal insertion hole 50*a* discussed herein is formed in the same shape as that of the through-hole 41.

In the reinforcing plate 50, an intersection part 50*b* where the first plane 51 intersects with an end face 53 disposed on the outlet 30*c* side (that is, the end face 53 on the lead-out direction side) is formed in a sharp edge form (FIG. 10). For example, the reinforcing plate 50 discussed herein is formed with fiber reinforced plastic (FRP). Thus, as for the reinforcing plate 50, all end faces including the end face 53 are formed by cutting. Therefore, the intersection part 50*b* in the reinforcing plate 50 is shaped into a sharp edge form.

For example, in a laminated part configured with the conductor connection area 40*a* and the reinforcing plate 50 discussed herein, the conductor connection parts 12 of all of the terminal fittings 10 accommodated in the housing chambers 20*a* are inserted into the through-holes 41 and the terminal insertion holes 50*a*, so that the second plane 52 of the reinforcing plate 50 is placed on the terminal lead-out area 20*c* of the housing main body 21. At that time, the reinforcing plate 50 can suppress changes in the shape and posture of the conductor connection area 40*a* due to deflection or the like, so that it is possible to improve operability when inserting all of the conductor connection parts 12 into the through-holes 41. As for the connector 1, in a state where the terminal fittings 10, the housing 20, the conductive component 40, and the reinforcing plate 50 are mounted, soldering is performed for each combination of the conductor connection part 12 and the through-hole 41 as a pair so as to fix the conductor connection part 12 and the through-hole 41. Thereafter, the cover 30 is assembled to the connector 1.

Incidentally, with the connector 1, the conductor lead-out area 40*b* of the conductive component 40 may be pulled out toward the lead-out direction from the outlet 30*c* by an operator when the operator performs installation work of the conductive component 40 to the terminal fittings 10 and the housing 20 while inserting the conductor connection parts 12 to the through-holes 41 and the terminal insertion holes 50*a*, or after the installation work where it is possible to perform connection work of the conductor connection parts 12 and the through-holes 41. Therefore, the connector 1 allows the reinforcing plate 50 to receive the force generated by the operator pulling so as to suppress the force transmitted between the conductor connection parts 12 of the terminal fittings 10 and the peripheral edges of the through-holes 41 of the conductive component 40.

Specifically, the housing 20 includes columnar or cylindrical locking protrusions 24 having the protruding direction of the conductor connection part 12 as the axial direction. One each of the locking protrusions 24 is provided so as to sandwich the terminal lead-out area 20*c* in an orthogonal direction to the protruding direction of the conductor connection part 12 from the terminal outlet 20*b* and to the lead-out direction of the conductor lead-out area 40*b* from the outlet 30*c* (FIG. 4, FIG. 5, and FIG. 7). Furthermore, in the conductor connection area 40*a* and the reinforcing plate 50 herein, through-holes 42, 50*c* for inserting the locking protrusions 24 are provided for each of the locking protrusions 24 (FIG. 7 and FIG. 8). In the connector 1, the through-hole 50*c* of the reinforcing plate 50 is formed smaller than the through-hole 42 of the conductor connection area 40*a* to be able to lock the conductor connection part 12 with the peripheral edge of the through-hole 50*c* of the reinforcing plate 50, so that the reinforcing plate 50 can receive the force generated when the conductor lead-out area 40*b* is pulled. This makes it possible to improve the durability of the conductive component 40 in the connector 1.

The cover 30 is formed with an insulating material such as a synthetic resin. The cover 30 is assembled to the housing 20 to cover the housing 20 from the outer side. Specifically, the cover 30 is formed to cover the part of the housing 20 projecting from the mating fitting connection part 521*g* from the outer side, when the fitting connection part 21*g* and the mating fitting connection part 521*g* are in a completely fitted and connected state. In other words, the cover 30 is formed to cover the remaining part of the housing 20 in a state where the fitting connection part 21*g* projects from the inner space within the cover. Therefore, the cover 30 covers the terminal lead-out area 20*c* (that is, the conductor connection parts 12 of all of the terminal fittings 10 projecting from the terminal outlet 20*b*).

The cover 30 includes a cover main wall 31 that forms the main body for covering the protruded part mentioned above (the protruded part of the housing 20 from the mating fitting connection part 521*g* when the fitting connection part 21*g* and the mating fitting connection part 521*g* are in a completely fitted and connected state) (FIG. 1 and FIG. 4 to FIG. 6). The cover main wall 31 discussed herein includes a first wall body 31A and a second wall body 31B joined in an intersecting state (FIG. 5 and FIG. 6). As for the cover 30, the first wall body 31A is disposed by opposing to the first outer wall face 21*a* with a space provided therebetween, and the second wall body 31B is disposed by opposing to the first outer wall face 21*a* side of the fifth outer wall face 21*e* with a space provided therebetween.

Furthermore, the cover 30 includes a first cover sidewall 32 and a second cover sidewall 33 having flexibility, which are opposingly disposed with a space provided therebetween and joined, respectively, to both ends of the cover main wall 31 in an orthogonal state (FIG. 1 to FIG. 3, FIG. 5, and FIG. 6). The first cover sidewall 32 and the second cover sidewall 33 are opposingly disposed with a space provided therebetween in the orthogonal direction to the connector insertion direction (or the connector removal direction) and to the lead-out direction of the conductive component 40 (hereinafter, referred to as "width direction"). Furthermore, the first cover sidewall 32 and the second cover sidewall 33 are joined in an orthogonal state, respectively, to both ends of the cover main wall 31 in the width direction (both ends of each of the first wall body 31A and the second wall body 31B).

In the cover 30 when being completely assembled to the housing 20, the first cover sidewall 32 in a planar shape is disposed by opposing to the flat plate part 22*a* of the first housing sidewall 22 from the outer side in a parallel state, and the second cover sidewall 33 in a planar shape is disposed by opposing to the flat plate part 23*a* of the second housing sidewall 23 from the outer side in a parallel state. The first cover sidewall 32 is formed to be flexibly deformed at least in a direction leaving away from the first housing sidewall 22. Furthermore, the second cover sidewall 33 is formed to be flexibly deformed at least in a direction leaving away from the second housing sidewall 23.

The cover 30 includes: a first opening 30*a* having, as its peripheral edge, end portions of each of the cover main wall 31, the first cover sidewall 32, and the second cover sidewall 33 on the connector insertion direction side; and a second opening 30*b* which has, as its peripheral edge, end portions of each of the cover main wall 31, the first cover sidewall 32, and the second cover sidewall 33 in the lead-out direction of the conductive component 40 (that is, the orthogonal direction to the opposingly disposed direction of the first cover sidewall 32 and the second cover sidewall 33 (width direction) and to the connector insertion direction (or the connector removal direction)), and a part of which is used as the outlet 30*c* of the conductive component 40 to be described later (FIG. 6). The first opening 30*a* discussed herein is disposed by opposing to the first wall body 31A on the connector insertion direction side with a space provided therebetween, and it is formed as an opening having the side portions of each of the second wall body 31B, the first cover sidewall 32, and the second cover sidewall 33 as the peripheral edge. Furthermore, the second opening 30*b* discussed herein is disposed by opposing to the second wall body 31B with a space provided therebetween, and it is formed as an opening having the side portions of each of the first wall body 31A, the first cover sidewall 32, and the second cover sidewall 33 as the peripheral edge. In the cover 30, the first opening 30*a* and the second opening 30*b* are joined in an orthogonal state. Therefore, each of the first cover sidewall 32 and the second cover sidewall 33 has the largest deflection amount in the intersection part where the first opening 30*a* intersects with the second opening 30*b*.

In the connector 1, a space is formed between the first outer wall face 21*a* of the housing main body 21, the protruded part 22*a*; of the first protector 22, and the protruded part 23*a*; of the second protector 23, as well as the first wall body 31A and the second wall body 31B of the cover 30, and the conductor connection parts 12 of all of the terminal fittings 10 are arranged in the space. Furthermore, as for the connector 1, the space communicates with the outer side via a part of the second opening 30*b*. That part of the second opening 30*b* is a gap formed between the housing 20 and the first wall body 31A (FIG. 3, FIG. 4, and FIG. 10). Therefore, in the connector 1, the gap is the opening (hereinafter, referred to as "outlet") 30*c* from which the conductive component 40 is pulled out to the outer side from the sixth outer wall face 21*f* side.

Figure 2:
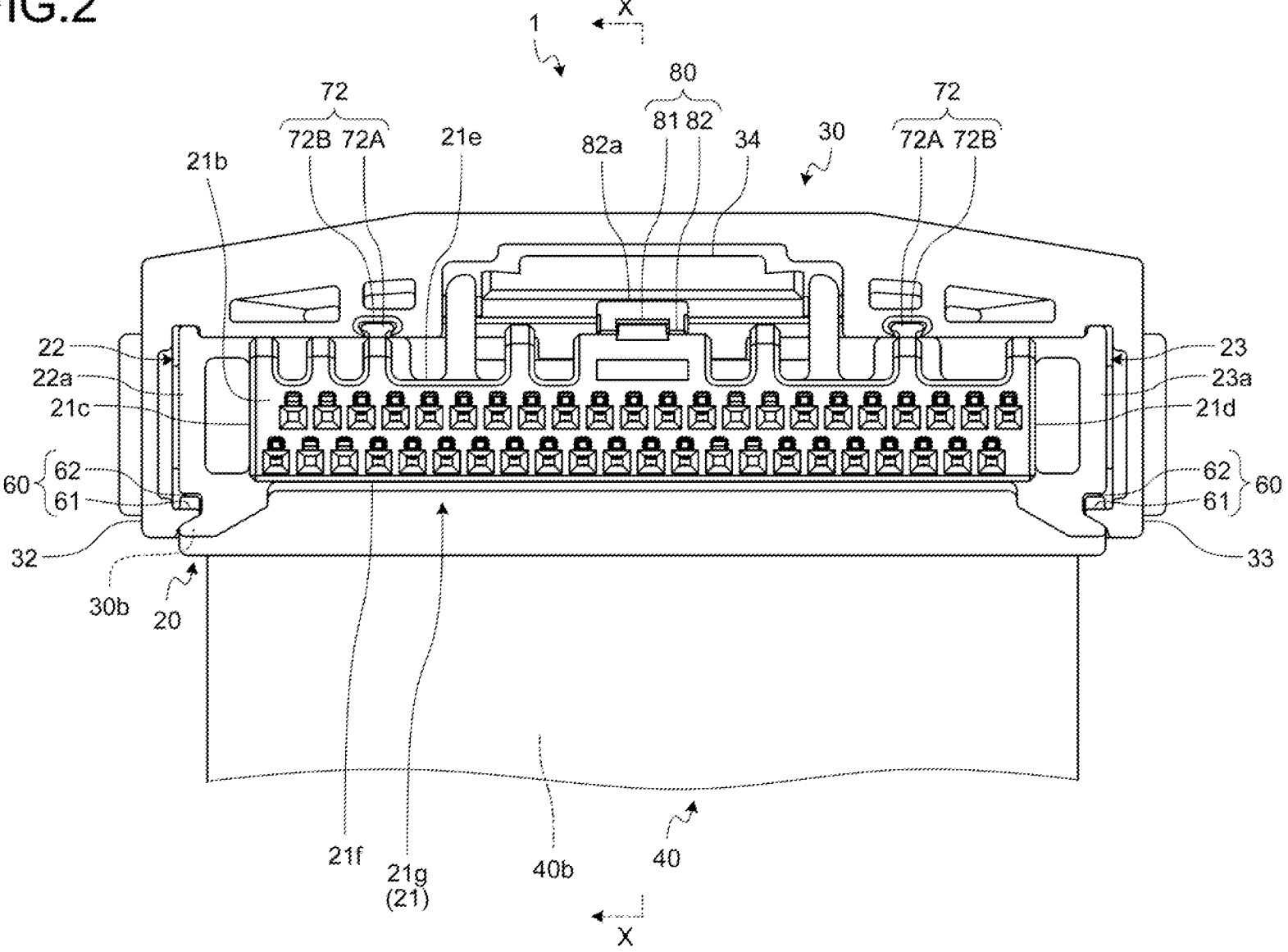
FIG. 2 is a plan view of the connector of the embodiment when viewed from a fitting connection part side.

The cover 30 is inserted and connected to the housing 20 from the first outer wall face 21*a* side along the connector fitting direction. Between the housing 20 and the cover 30, a guide structure 60 is provided for guiding those with each other to the completely assembled position along the connecting direction thereof (FIG. 1, FIG. 2, and FIG. 6). The guide structure 60 is a protrusion provided to one of the housing 20 and the cover 30, and includes: a guide protrusion 61 extended along the connecting direction with a wedge-shaped orthogonal section to the connecting direction; and a guide groove 62 that is a groove provided to the other of the housing 20 and the cover 30, which is extended along the connecting direction for being guided and for guiding the inserted guide protrusion 61 along the connecting direction. The guide protrusion 61 and the guide groove 62 at least have two planes in parallel to or intersecting with each other along the connecting direction of the housing 20 and the cover 30.

In the connector 1 discussed herein, the guide structure 60 is provided in two areas. The guide structures 60 in the two areas are provided such that the protruding direction of one of the guide protrusions 61 and the protruding direction of the other guide protrusion 61 are opposite from each other. The guide protrusion 61 discussed herein is provided to the first cover sidewall 32 and the second cover sidewall 33 of the cover 30. Herein, the guide protrusion 61 is formed in the side portion on the second opening 30*b* side of each of the first cover sidewall 32 in a rectangular planar shape and the second cover sidewall 33 in a rectangular planar shape. In the cover 30, each of the guide protrusions 61 is protruded toward the inner side, and disposed to oppose to each other. Furthermore, the guide groove 62 discussed herein is provided to the first housing sidewall 22 and the second housing sidewall 23 of the housing 20. The guide groove 62 on the first housing sidewall 22 is disposed adjacent to the flat plate part 22*a* on the sixth outer wall face 21*f* side. The guide groove 62 on the second housing sidewall 23 is disposed adjacent to the flat plate part 23*a* on the sixth outer wall face 21*f* side.

Furthermore, a locking structure (hereinafter, referred to as "first locking structure") 71 is provided between the housing 20 and the cover 30 for locking the move thereof in the direction opposite from the direction connected to each other in a completely assembled state (FIG. 6). The first locking structure 71 includes a first locking body 71A provided to the housing 20 and a second locking body 71B provided to the cover 30. The first locking body 71A and the second locking body 71B are arranged to oppose to each other for locking the move in the opposite direction of the connecting direction when the housing 20 and the cover 30 are in a completely assembled state.

In the connector 1 discussed herein, the first locking structure 71 is provided at two areas that are between the first protector 22 and the first cover sidewall 32 and between the second protector 23 and the second cover sidewall 33. Herein, each of the first locking body 71A and the second locking body 71B is formed as a protrusion. The first locking bodies 71A are protruded toward the outer side from the outer wall faces of the first protector 22 and the second protector 23, respectively. The first locking bodies 71A are formed such that the protruding directions thereof are opposite from each other. Furthermore, the second locking bodies 71B are protruded toward the inner side from the inner wall faces of the first cover sidewall 32 and the second cover sidewall 33, respectively. The second locking bodies 71B are formed such that the protruding directions thereof are opposite from each other.

The first cover sidewall 32 and the second cover sidewall 33 discussed herein have flexibility as described above. Therefore, with the connector 1, when the housing 20 and the cover 30 are being inserted and connected along the guide structure 60, the first locking bodies 71A and the second locking bodies 71B as pairs apply the force to the inclined faces of them, and at the same time, deflection of the first cover sidewall 32 and the second cover sidewall 33 is caused. Then, in the connector 1, the first locking bodies 71A and the second locking bodies 71B as pairs are shifted each other while deflection of the first cover sidewall 32 and the second cover sidewall 33 is caused, and the first locking bodies 71A and the second locking bodies 71B are opposingly disposed to be in a lockable state in the opposite direction of the connecting direction in addition to elimination of deflection of the first cover sidewall 32 and the second cover sidewall 33.

Furthermore, a locking structure (hereinafter, referred to as "second locking structure") 72 is provided between the housing 20 and the cover 30 for locking the move thereof in the orthogonal direction to the direction connected to each other and to the opposingly disposed direction of the first cover sidewall 32 and the second cover sidewall 33 (that is, the lead-out direction of the conductive component 40) in a completely assembled state (FIG. 2 and FIG. 6). The second locking structure 72 includes a first locking body 72A provided to the housing 20 and a second locking body 72B provided to the cover 30.

In the second locking structure 72 illustrated herein, the first locking body 72A is provided in a protruded state on the first outer wall face 21*a* side of the fifth outer wall face 21*e* of the housing main body 21, and the second locking body 72B is formed on the second wall body 31B of the cover 30 as a locking groove with which the first locking body 72A is engaged. The first locking body 72A and the second locking body 72B form a three-dimensional shape extended along the connecting direction with substantially a trapezoid orthogonal section to the connecting direction of the housing 20 and the cover 30. The first locking body 72A and the second locking body 72B are formed such that the upper base of substantially the trapezoid orthogonal section faces toward the fifth outer wall face 21*e* side. Therefore, the first locking body 72A and the second locking body 72B lock the relative move of the conductive component 40 in the lead-out direction when the housing 20 and the cover 30 are in a completely assembled state. Furthermore, the first locking body 72A and the second locking body 72B also function as a guide structure when the housing 20 and the cover 30 are inserted and connected. In the connector 1 discussed herein, the second locking structure 72 is provided in two areas.

Furthermore, in the connector 1, as described above, the fitting connection part 21*g* of the housing main body 21 is fitted and connected to the mating fitting connection part 521*g* of the mating housing 520. Herein, the mating fitting connection part 521*g* is formed in a rectangular tubular shape, and the fitting connection part 21*g* is inserted and fitted to the inner side of the mating fitting connection part. 521*g*. Between the housing 20 and the mating housing 520, a holding structure 80 is provided for maintaining the completely fitted and connected state (FIG. 1, FIG. 2, and FIG. 5 to FIG. 8). As the structural elements of the holding structure 80, the housing 20 includes: a locking body 81 that is engaged with a mating locking body 521*h* of the mating fitting connection part 521*g* (FIG. 9) in the opposite direction of the fitting-connecting direction when the fitting connection part 21*g* and the mating fitting connection part 521*g* are in a completely fitted and connected state so as to maintain the fitting connection part 21*g* and the mating fitting connection part 521*g* in a completely fitted and connected state; and a locking release arm 82 that releases the lockable state of the locking body 81 and the mating locking body 521*h* by being deflected upon a locking release force applied to a force point 82*a*.

The locking body 81 and the locking release arm 82 are arranged on the opposite side of the second opening 30*b* side of the housing 20 (that is, on the fifth outer wall face 21*e* side of the housing 20) when the housing 20 and the cover 30 are in a completely assembled state.

Furthermore, the locking release arm 82 is formed to be operated by being pushed toward the second opening 30*b* side (that is, toward the fifth outer wall face 21*e*) when the lockable state of the locking body 81 and the mating locking body 521*h* is released. The locking release arm 82 has the force point 82*a* as an area for allowing an operator to perform the pushing operation.

Herein, the locking body 81 is formed as a locking protrusion, and the mating locking body 521*h* is formed as a perforated hole to which the locking body 81 is inserted and engaged. The locking body 81 discussed herein is engaged with a peripheral wall of the mating locking body 521*h* as the perforated hole. Furthermore, the locking release arm 82 is in a cantilever form that can be elastically deformed with the fixed end being the fulcrum. Herein, the fixed end is provided on the fitting connection part 21*g* side of the fifth outer wall face 21*e*, and the free end is provided on the first outer wall face 21*a* side of the fifth outer wall face 21*e* (part excluding the fitting connection part 21*g*). As for the locking release arm 82, the free end is the force point 82*a*. The force point 82*a* herein is formed in a rectangular planar shape. Furthermore, the locking release arm 82 has wall faces opposingly disposed with a space provided therebetween on the fitting connection part 21*g* side of the fifth outer wall face 21*e* of the housing main body 21. In the locking release arm 82, on the wall face on the opposite side from the wall faces mentioned above, the locking body 81 is provided in a protruded state between the fixed end and the free end. With the locking release arm 82 formed in this manner, a locking release force toward the fifth outer wall face 21*e* is applied to the force point. 82*a*, when the lockable state of the locking body 81 and the mating locking body 521*h* is released. With the holding structure 80, the locking release arm 82 is deflected by the locking release force and the locking body 81 is displaced toward the fifth outer wall face 21*e* side concurrently with the deflection of the locking release arm 82, thereby releasing the lockable state of the locking body 81 and the mating locking body 521*h*.

As for the cover 30 as described above, the second wall body 31B is disposed by opposing to the first outer wall face 21*a* side of the fifth outer wall face 21*e* with a space provided therebetween, so that not only the first outer wall face 21*a* side of the fifth outer wall face 21*e* but also the free end (that is, the force point 82*a*) of the locking release arm 82 is covered with the second wall body 318. Therefore, the second wall body 31B is provided with a pushing part 34 that covers the force point 82*a* and pushes and moves the force point 82*a* toward the fifth outer wall face 21*e* side by being displaced toward the second opening 30*b* side (the fifth outer wall face 21*e* side) (FIG. 1, FIG. 2, FIG. 5, FIG. 6, and FIG. 9). The pushing part 34 is formed in a cantilever form having flexibility. The pushing part 34 discussed herein is formed in a piece element with the first wall body 31A side being the fixed end and the first opening 30*a* side being the free end. By being pushed toward the fifth outer wall face 21*e* side, the pushing part 34 pushes and moves the force point 82*a* in a contact state toward the fifth outer wall face 21*e* side to release the lockable state of the locking body 81 and the mating locking body 521*h*.

As described above, in the connector 1, the conductive component 40 is in a cantilever state with the conductor connection area 40*a* being the fixed end and the conductor lead-out area 40*b* being the free end until the conductor lead-out area 40*b* is fixed. Therefore, the conductor lead-out area 40*b* side may be oscillated to the planar direction (the direction of an arrow A1 or the direction of an arrow A2 in FIG. 11) due to an externally applied force such as vibration during transportation or the conductor lead-out area 40*b* side may droop in the planar direction (downward along the vertical direction) by its own weight when the connector 1 is placed such that the plane of the conductor lead-out area 40*b* is the plane orthogonal to the vertical direction. Furthermore, in the connector 1, the reinforcing plate 50 is interposed between the conductor connection area 40*a* and the terminal lead-out area 20*c*. Therefore, when the conductor lead-out area 40*b* side is oscillated toward the direction of the arrow A1 (that is, to the reinforcing plate 50 side) or the conductor lead-out area 40*b* side droops toward the housing 20 side (that is, to the reinforcing plate 50 side) by its own weight, the conductive component 40 may be bent at the end of the reinforcing plate 50 on the end face 53 side. Especially, in the reinforcing plate 50 discussed herein, the intersection part 50*b* where the first plane 51 intersects with the end face 53 is formed in a sharp edge form as described above. Therefore, in the conductive component 40, when the bent part that is bent by the intersection part 50*b* comes to have a small curvature radius and overload is applied to the bent part, the circuit part existing in the bent part of the conductive component 40 may have the overload applied thereto.

Therefore, in the connector 1, a part for lightening the load to the bent part of the conductive component 40 is provided to the housing 20. Specifically, in the housing 20, on the lead-out direction side from the terminal lead-out area 20*c*, a protruded body 25 is provided by being protruded toward the conductor lead-out area 40*b* of the conductive component 40 from the same plane with the terminal lead-out area 20*c* (FIG. 3 to FIG. 5, FIG. 7, and FIG. 10).

Thereby, in the connector 1, even when the position of an end face 25*a* of the protruded body 25 on the protruding direction side (FIG. 10) is lower than the position of the first plane 51 of the reinforcing plate 50 with the second plane 52 being in contact with the terminal lead-out area 20*c* (that is, the reinforcing plate 50 that is being assembled to the housing 20), the conductor lead-out area 40*b* of the conductive component 40 is locked by the protruded body 25, so that the contact amount and drooping amount of the conductor lead-out area 40*b* side is suppressed. Therefore, the curvature radius of the bent part of the conductive component 40 bent from the intersection part 50*b* of the reinforcing plate 50 can be increased. As a result, in the conductive component 40, the load imposed upon the bent part that is bent by the intersection part 50*b* of the reinforcing plate 50 is lightened. Thereby, with the connector 1, it is possible to protect the circuit part of the conductive component 40, so that the durability can be improved and the electrical conduction quality can be secured as well.

Furthermore, with the connector 1, the conductive component 40 cannot be bent from the intersection part 50*b* of the reinforcing plate 50 when the position of the end face 25*a* of the protruded body 25 is higher than the position of the first plane 51 of the reinforcing plate 50 that is being assembled to the housing 20. Therefore, there is no load imposed upon the conductive component. 40 from the intersection part 50*b*. Meanwhile, with the connector 1 in this case, even though the conductive component 40 is bent by the protruded body 25 toward the direction of the arrow A2 illustrated in FIG. 11, no origin of bending exists in that direction. Therefore, the curvature radius of the bent part by the protruded body 25 becomes greater than the curvature radius of the bent part bent by the intersection part 50*b* of the reinforcing plate 50. Thus, in the conductive component 40, the load imposed upon the bent part bent by the protruded body 25 is smaller than the load imposed upon the bent part bent by the intersection part 50*b* of the reinforcing plate 50. Therefore, even when such a protruded body 25 is used, it is possible, with the connector 1, to protect the circuit part of the conductive component 40, so that the durability can be improved and the electrical conduction quality can be secured as well.

Furthermore, with the connector 1, there is no bending of the conductive component 40 from the intersection part 50*b* of the reinforcing plate 50 nor bending of the conductive component 40 by the protruded body 25, when the position of the end face 25*a* of the protruded body 25 is the same with the position of the first plane 51 of the reinforcing plate 50 that is being assembled to the housing 20. Thus, there is no load imposed upon the conductive component 40 from the intersection part 50*b* and the protruded body 25. Therefore, the connector 1 in this case can protect the circuit part of the conductive component 40 most efficiently, thereby forming a best mode for improving the durability and securing the electrical conduction quality. This case is illustrated herein (FIG. 10).

As described above, there is no bending of the conductive component 40 caused from the intersection part 50*b* of the reinforcing plate 50, so that it is desirable for the protruded body 25 to be protruded to a position equivalent to the first plane 51 of the reinforcing plate 50 being assembled to the housing 20 or to a position higher than the first plane 51. Especially, it is desirable for the protruded body 25 to be protruded to a position equivalent to the first plane 51 of the reinforcing plate 50 in an assembled state, since it is possible to suppress the load applied to the conductive component 40 both from the intersection part 50*b* of the reinforcing plate 50 and the protruded body 25.

Specifically, the protruded body 25 discussed herein is protruded from the first outer wall face 21*a* that is on the same plane with the terminal lead-out area 20*c*.

Furthermore, the end face 25*a* of the protruded body 25 discussed herein is extended in the orthogonal direction to its protruding direction and to the lead-out direction and extended over one end to the other end of the conductor lead-out area 40*b* in the orthogonal direction. Therefore, with the connector 1, it is possible to support the conductor lead-out area 40*b* over its one end to the other end by the protruded body 25, so that the load to be applied to the conductive component 40 can be dispersed and lightened when the position of the first plane 51 of the reinforcing plate 50 in an assembled state is not same with the position of the end face 25*a* of the protruded body 25. In this case illustrated herein, the end face 25*a* is extended to be projecting from one end and the other end of the conductor lead-out area 40*b*, respectively.

The protruded body 25 discussed herein has a chamfered part 25*c* formed by chamfering the intersection part where the end face 25*a* intersects with an end face 25*b* on the lead-out direction side (FIG. 10). Thereby, as for the conductive component 40, the curvature radius of the bent part bent from the chamfered part 25*c* can be increased compared to a case where no chamfered part 25*c* is formed, so that the load imposed upon the bent part can be lightened. For example, the chamfered part 25*c* may be a planar chamfered part chamfered in a planar shape (what is called C-chamfered plane) or may be an arc-like chamfered part rounded in an arc-like shape (what is called rounded plane). It is possible to lighten the load imposed upon the bent part of the conductive component 40, regardless whether the chamfered part 25*c* is a planar chamfered part or an arc-like chamfered part. However, the arc-like chamfered part can increase the lightening effect of the load more than the planar chamfered part can with edges intersecting at an obtuse angle remaining. For example, the protruded body 25 illustrated herein is formed in a cuboid shape and extended in the extending direction described above. Therefore, in the protruded body 25, each of the end faces 25*a* and 25*b* intersects at a right angle and the intersection part extended in the extending direction is chamfered. The chamfered part 25*c* herein is formed as an ark-like chamfered part.

As described above, with the connector 1 of the embodiment, the conductor lead-out area 40*b* can be supported by the protruded body 24 until the conductor lead-out area 40*b* is fixed, so that it is possible to eliminate bending of the conductive component 40 from the intersection part 50*b* of the reinforcing plate 50 or to lighten the bending amount thereof. Thus, since the load imposed upon the conductive component 40 until the conductor lead-out area 40*b* is fixed can be lightened with the connector 1 compared to the conventional ones, it is possible to improve the durability and secure the electrical conduction quality as well.

Furthermore, the reinforcing plate 50 of the connector 1 illustrated herein is formed with fiber reinforced plastic, so that it is necessary to chamfer the intersection part 50*b* separately, for example, in order to lighten the strong impact to the conductive component 40 caused by the sharp-edged intersection part 50*b* of the reinforcing plate 50. However, with the connector 1, it is possible to lighten the load by forming the protruded body 25 simultaneously when the housing 20 is molded and by using the protruded body 25 to lighten the load imposed upon the conductive component 40 without increasing the number of work steps such as performing chamfering of the intersection part 50*b*.

The connector according to the present embodiment is capable of supporting the conductor lead-out area by the protruded body until the conductor lead-out area is fixed, so that it is possible to avoid bending of the conductive component from the intersection part of the reinforcing plate or to lighten the bending amount thereof. Therefore, the connector is capable of lightening the load imposed upon the conductive component until the conductor lead-out area is fixed, compared to the conventional ones, so that it is possible to improve the durability and secure the electrical conduction quality as well.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting including a terminal part and a conductor connection part;

a housing including an inner housing chamber for accommodating the terminal part, and a smooth terminal lead-out area where a terminal outlet for projecting the conductor connection part toward an outer side from the inner housing chamber is provided;

a conductive component that is a component shaped in a sheet-like form with a conductor and an insulator exhibiting flexibility, the conductive component including a conductor connection area that physically and electrically connects the conductor to the conductor connection part, and a conductor lead-out area that is led out from the conductor connection area toward a lead-out direction to be projecting from the housing; and a reinforcing plate shaped in a planar shape with an insulating material, the reinforcing plate being sandwiched between the conductor connection area and the terminal lead-out area with a first plane being in contact with the conductor connection area and a second plane being in contact with the terminal lead-out area, wherein the housing includes a protruded body that is protruded in a protruding direction, that crosses the lead-out direction, from a plane of the terminal lead-out area directly towards the conductor lead-out area of the conductive component such that the protruded body is further than the terminal lead-out area in the protruding direction and an end face of the protruded body, in the protruding direction, directly faces towards the conductor lead-out area, and the protruded body is in the lead-out direction with respect to an end face of the reinforcing plate in the lead-out direction.

2. The connector according to claim 1, wherein an intersection part, of the reinforcing plate, where the first plane intersects with the end face of the reinforcing plate in the lead-out direction, is formed in a sharp edge form.

3. The connector according to claim 1, wherein the protruded body is protruded to a position equivalent to the first plane of the reinforcing plate with the second plane being in contact with the terminal lead-out area or to a position higher than the first plane.

4. The connector according to claim 3, wherein the end face of the protruded body, in the protruding direction, is extended in an orthogonal direction with respect to the protruding direction and with respect to the lead-out direction, and extended over one end to another end of the conductor lead-out area along the orthogonal direction.

5. The connector according to claim 3, wherein an intersection part, of the reinforcing plate, where the first plane intersects with the end face of the reinforcing plate in the lead-out direction, is formed in a sharp edge form.

6. The connector according to claim 1, wherein the protruded body includes a chamfered part formed by chamfering an intersection part of the protruded body where the end face of the protruded body in the protruding direction intersects with an end face of the protruded body in the lead-out direction.

7. The connector according to claim 6, wherein an intersection part, of the reinforcing plate, where the first plane intersects with the end face of the reinforcing plate in the lead-out direction is formed in a sharp edge form.

8. The connector according to claim 6, wherein the end face of the protruded body, in the protruding direction, is extended in an orthogonal direction with respect to the protruding direction and with respect to the lead-out direction, and extended over one end to another end of the conductor lead-out area along the orthogonal direction.

9. The connector according to claim 8, wherein an intersection part, of the reinforcing plate, where the first plane intersects with the end face of the reinforcing plate in the lead-out direction, is formed in a sharp edge form.

10. The connector according to claim 6, wherein the protruded body is protruded to a position equivalent to the first plane of the reinforcing plate with the second plane being in contact with the terminal lead-out area or to a position higher than the first plane.

11. The connector according to claim 10, wherein the end face of the protruded body, in the protruding direction, is extended in an orthogonal direction with respect to the protruding direction and with respect to the lead-out direction, and extended over one end to another end of the conductor lead-out area along the orthogonal direction.

12. The connector according to claim 10, wherein an intersection part, of the reinforcing plate, where the first plane intersects with the end face of the reinforcing plate in the lead-out direction, is formed in a sharp edge form.

13. The connector according to claim 6, wherein the chamfered part is an arc-like chamfered part rounded in an arc-like shape.

14. The connector according to claim 13, wherein the end face of the protruded body, in the protruding direction, is extended in an orthogonal direction with respect to the protruding direction and with respect to the lead-out direction, and extended over one end to another end of the conductor lead-out area along the orthogonal direction.

15. The connector according to claim 13, wherein an intersection part, of the reinforcing plate, where the first plane intersects with the end face of the reinforcing plate in the lead-out direction, is formed in a sharp edge form.

16. The connector according to claim 13, wherein the protruded body is protruded to a position equivalent to the first plane of the reinforcing plate with the second plane being in contact with the terminal lead-out area or to a position higher than the first plane.

17. The connector according to claim 16, wherein the end face of the protruded body, in the protruding direction, is extended in an orthogonal direction with respect to the protruding direction and with respect to the lead-out direction, and extended over one end to another end of the conductor lead-out area along the orthogonal direction.

18. The connector according to claim 16, wherein an intersection part, of the reinforcing plate, where the first plane intersects with the end face of the reinforcing plate in the lead-out direction, is formed in a sharp edge form.

19. A connector comprising:

a terminal fitting including a terminal part and a conductor connection part;

a housing including an inner housing chamber for accommodating the terminal part and a smooth terminal lead-out area where a terminal outlet for projecting the conductor connection part toward an outer side from the inner housing chamber is provided;

a conductive component that is a component shaped in a sheet-like form with a conductor and an insulator exhibiting flexibility, the conductive component including a conductor connection area that physically and electrically connects the conductor to the conductor connection part, and a conductor lead-out area that is led out from the conductor connection area toward a lead-out direction to be projecting from the housing; and a reinforcing plate shaped in a planar shape with an insulating material, the reinforcing plate being sandwiched between the conductor connection area and the terminal lead-out area with a first plane being in contact with the conductor connection area and a second plane being in contact with the terminal lead-out area, wherein the housing includes a protruded body that is protruded in a protruding direction, that crosses the lead-out direction, from a plane of the terminal lead-out area directly towards the conductor lead-out area of the conductive component such that the protruded body is further than the terminal lead-out area in the protruding direction and an end face of the protruded body, in the protruding direction, directly faces towards the conductor lead-out area, and the end face of the protruded body, in the protruding direction, is extended in an orthogonal direction with respect to the protruding direction and with respect to the lead-out direction, and extended over one end to another end of the conductor lead-out area along the orthogonal direction.

20. The connector according to claim 19, wherein an intersection part, of the reinforcing plate, where the first plane intersects with the end face of the reinforcing plate in the lead-out direction, is formed in a sharp edge form.

* * * * *